US010631614B2

(12) United States Patent
Haloulos et al.

(10) Patent No.: US 10,631,614 B2
(45) Date of Patent: Apr. 28, 2020

(54) HOT POUR COSMETIC MIXING AND KIT

(76) Inventors: Peter Haloulos, Woodstock (CA); Voula Lily Haloulos, Toronto (CA)

( * ) Notice: Subject to any disclaimer, the term of this patent is extended or adjusted under 35 U.S.C. 154(b) by 835 days.

(21) Appl. No.: 12/923,954

(22) Filed: Oct. 18, 2010

(65) Prior Publication Data

US 2011/0155160 A1 Jun. 30, 2011

Related U.S. Application Data

(63) Continuation-in-part of application No. 11/491,653, filed on Jul. 24, 2006, now abandoned.

(51) Int. Cl.
*A45D 40/00* (2006.01)
*A45D 44/00* (2006.01)

(52) U.S. Cl.
CPC ..... *A45D 40/00* (2013.01); *A45D 44/005* (2013.01); *A45D 2200/058* (2013.01); *A45D 2200/155* (2013.01); *A45D 2200/25* (2013.01)

(58) Field of Classification Search
CPC ..... A45D 40/00; A45D 44/005; A45D 2200/155; A45D 2200/25; A45D 2200/058
USPC ..... 206/81, 1.7, 1.8, 1.9, 581, 823; 132/320, 132/200; 434/103, 100
See application file for complete search history.

(56) References Cited

U.S. PATENT DOCUMENTS

| | | | | |
|---|---|---|---|---|
| 5,780,018 | A * | 7/1998 | Collins et al. | 424/64 |
| 5,971,351 | A * | 10/1999 | Swaab | 249/117 |
| 6,177,093 | B1 * | 1/2001 | Lombardi et al. | 424/401 |
| 6,223,503 | B1 * | 5/2001 | Berman et al. | 53/440 |
| 2003/0131868 | A1 * | 7/2003 | Stanley, III | 132/294 |
| 2005/0218560 | A1 * | 10/2005 | Booth | 264/299 |
| 2006/0001193 | A1 * | 1/2006 | Booth | 264/319 |
| 2006/0226032 | A1 * | 10/2006 | Zalsman | 206/63.5 |

* cited by examiner

*Primary Examiner* — Jacob K Ackun
*Assistant Examiner* — Jenine Pagan

(57) ABSTRACT

A kit and method for providing the consumer with supplies and instructions that can be used to blend their own custom color or predefined hot pour cosmetic color shades. The hot pour cosmetics involved include but are not limited to lipstick, lip gloss, foundation, cream blush and cream eye-shadow.

19 Claims, 2 Drawing Sheets

BLISTER PACKAGING

PLASTIC MIXING BOARD

PLASTIC OR FOIL LAMINATE TUBE OR SACHET PACKAGING

EMPTY PLASTIC CASE

PLASTIC SPATULA

APPLICATOR BRUSH

COLOR SHADE CHART

HOT POUR COSMETIC MIXING AND KIT

This application is a continuation-in-part application of U.S. patent application Ser. No. 11/491,653 filed on Jul. 24, 2006.

FIELD OF INVENTION

The field of invention relates to cosmetic compositions, specifically a method and kit, for blending a plurality of hot pour cosmetic color shades to produce a custom or predefined hot pour cosmetic color shade.

BACKGROUND OF THE INVENTION

The cosmetics industry is comprised of numerous retailers and manufacturers all offering a plethora of beauty products to suit various consumers and their complexions. Color cosmetics, a sizeable piece of the industry, offers consumers the choice of selecting a shade that meets their requirements and suits their complexion. The design of personalized cosmetics is a relatively new area of the industry.

A system of customizing lipstick currently exists under U.S. Pat. Nos. 6,405,120 and 5,971,351. However, this method and apparatus involves heating the product in order to facilitate molding the lipstick into its standard form. It also involves the use of a graduated blending sheet wherein the pigments and bases are measured and mixed prior to melting and subsequent molding.

A system of customizing hot pour cosmetic color shades at ambient temperature and without the use of a medium to heat and melt the hot pour cosmetic color shades does not currently exist. A system of customizing hot pour cosmetic color shades at ambient temperature and being able to repeat the shades that have been customized does not currently exist.

SUMMARY OF THE INVENTION

It is the goal of the present invention to provide a simple method for the custom blending of a plurality of hot pour cosmetic color shades at ambient temperature to form a uniformly mixed hot pour cosmetic color shade at ambient temperature and providing a kit for this process that can be utilized by consumers.

The kit provides the consumer with supplies and instructions that can be used to blend their own custom color or predefined hot pour cosmetic color shade based on a proprietary mixing system. The hot pour cosmetics involved include but are not limited to lipstick, lip gloss, foundation, cream blush and cream eyeshadow.

The kit may include the following items: a plurality of specially formulated hot pour cosmetic color shades such as but not limited to red, black, orange, white and brown; specially formulated hot pour cosmetic base which is free of any color; specially formulated hot pour cosmetic base that contains frost pigments; plastic blister packaging; plastic or foil laminate tubes or sachets; a plastic mixing tray; an applicator brush; a plastic spatula; an instruction/color shade chart and an empty cosmetic compact. The red, black, orange, white and brown hot pour base colors are comprised but not limited to the following: specially formulated hot pour cosmetic base, mica, red iron oxide, brown iron oxide, black iron oxide, titanium dioxide, bismuth oxychloride, D&C Red No. 7 Ca Lake, D&C Red No. 33 Al Lake, FD&C Yellow No. 5 Al Lake, FD&C Yellow No. 6 Al Lake, FD&C Blue No. 1 Al Lake and Manganese Violet. The hot pour cosmetic base that is used to make the hot pour cosmetic color shades is specially formulated so that it can be mixed with a similar hot pour cosmetic color shade at ambient temperature to create a single, uniform hot pour cosmetic color shade. It is common in the cosmetics industry for hot pour cosmetics to be heated and melted in order to facilitate mixing of the waxes, oils, and pigment blends in order to form a single, uniform cosmetic color shade. The current invention improves on this fact as it provides for a mixing process that does not involve the use of a heating medium to facilitate the mixing process. The consumer mixes the plurality of hot pour cosmetic color shades and clear hot pour base at ambient temperature with the use of a plastic spatula. Alternatively, the consumer mixes the plurality of hot pour cosmetic color shades at ambient temperature without the clear hot pour base and with the use of a plastic spatula. The resulting hot pour cosmetic color shade is then placed in an empty compact for future use.

The hot pour cosmetic color shades and base that is free of color are contained in individual blister packages. Each blister well is a predefined size and can hold from 0.1 to 10 grams of product. The consumer decides on a shade from the color shade chart and then proceeds to count the number of blister wells of each color that are required to obtain their desired shade of hot pour cosmetic. Thus, the individual blister wells are used as a means for measurement. The shade chart lists the amount of blister wells that are required for each shade. The consumer also has the option of entering their own custom shade values on the shade chart. Each color is then placed onto the plastic mixing tray along with the required amount of clear base and mixed until the color is uniform. Alternatively, each color is placed on the plastic mixing tray without any clear base and mixed until the desired shade is achieved. A feature of the kit is that the consumer can repeat a shade based on the measurements required on the shade chart or the measurements that they come up with for their custom shade.

Alternatively, the hot pour cosmetic color shades and base that is free of color are contained in individual plastic or foil laminate tube or sachet packaging. Each plastic or foil laminate tube or sachet is a predefined size and can hold from 0.1 to 100 grams of product. The consumer decides on a shade from the color shade chart and then proceeds to count the number of plastic or foil laminate tube or sachets of each color that are required to obtain their desired shade of hot pour cosmetic. Thus, the individual plastic or foil laminate tube or sachets are used as a means for measurement. The shade chart lists the amount of plastic or foil laminate tube or sachets that are required for each shade. The consumer also has the option of entering their own custom shade values on the shade chart. Each hot pour cosmetic color shade is then placed onto the plastic mixing tray along with the required amount of clear base and mixed until the color is uniform. Alternatively, each color is placed on the plastic mixing tray without any clear base and mixed until the desired shade is achieved.

The term "hot pour cosmetic" as defined in the invention is a cosmetic formulation that must be heated in order to melt and disperse its constituent ingredients which then solidify upon cooling. A feature of this kit is that the hot pour cosmetic is poured when hot into the blister packaging or hot or cold into the plastic or foil laminate tube or sachets. Thus, the hot pour cosmetic solidifies in the blister wells or the plastic or foil laminate tube or sachets and therefore does not need to be heated further. Another feature of the kit is that the hot pour cosmetic formulations have been developed in such a way as to facilitate the mixing process once the hot pour cosmetic color shade is scraped out of the blister well or squeezed out of the plastic or foil laminate tube or, sachet and placed onto the plastic mixing board. Thus, this removes the requirement for further heating in order to obtain the final hot pour cosmetic color shade and the entire mixing process takes place at ambient temperature.

Figure 1:
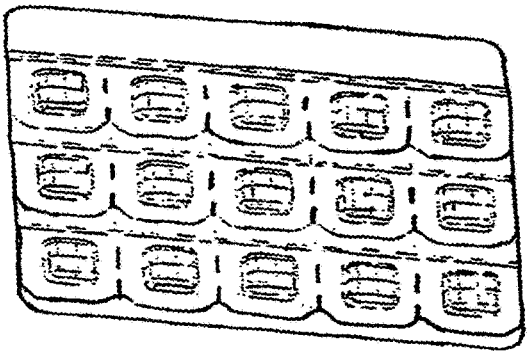
FIG. 1 shows the contents of the kit. Items shown are the blister packaging, plastic or foil laminate tube or sachet packaging, an empty plastic case, a spatula, an applicator brush and a plastic mixing board.
Figure 1:
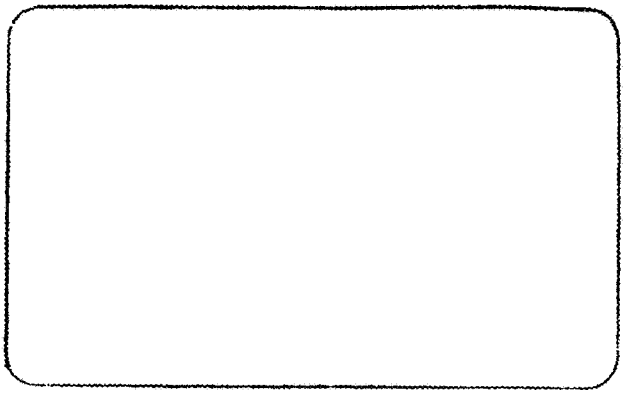
Figure 1:
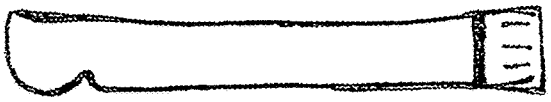
Figure 1:
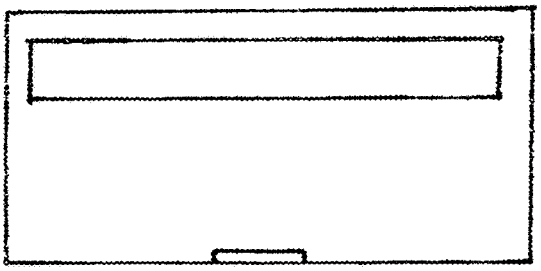
Figure 1:
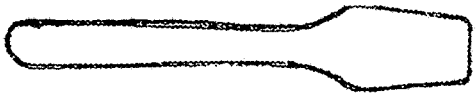
Figure 1:
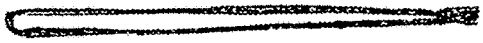
Figure 2:
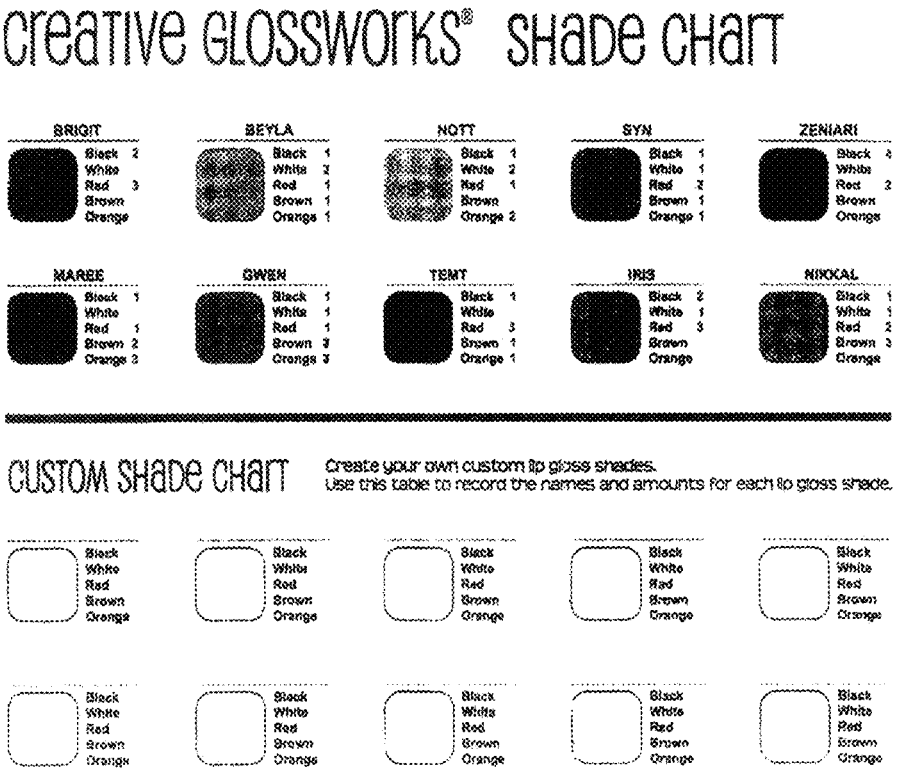
FIG. 2 is a graphic representation of the color shade chart showing predefined (lip gloss) shades that can be obtained with the kit. The color shade chart also provides an area for the consumer to enter their own color shades.

The invention claimed is:

1. A method for mixing cosmetic color shades at ambient temperature and without the use of a medium to melt the cosmetic color shades to form a single uniformly mixed cosmetic color shade also at ambient temperature comprising:

(a) a mixing the contents of a plurality of plastic blister wells from a plastic blister package comprising a plurality of blister wells as a means for measurement, the plurality of blister wells formed of material that withstands exposure to cosmetic color shades heated to pouring temperature;

(b) utilizing a plurality of cosmetic color shades specially formulated for pouring into one of the plurality of blister wells when heated, solidifying in the respective blister well, and, after solidifying at ambient temperature, mixing with another one or more of the plurality of cosmetic color shades also at ambient temperature;

(c) utilizing a plurality of cosmetic color shades enclosed respectively in the plurality of blister wells, the plurality of cosmetic color shades comprising one or more color shades;

(d) utilizing at least one plastic spatula and one plastic board for mixing the selected plurality of the plurality of cosmetic color shades at ambient temperature to form a single uniformly mixed cosmetic color shade also at ambient temperature; and (e) utilizing a color shade chart, the color shade chart comprising instructions for reproducibly mixing a selection of the plurality of cosmetic color shades at ambient temperature to a desired single uniform cosmetic color shade at ambient temperature based on a predetermined formula, the predetermined formula based on combinations of the plurality of blister wells.

2. The method according to claim 1, wherein the plurality of cosmetic color shades are of one type selected from the group comprising: lipstick, lip gloss, foundation, cream blush and cream eyeshadow.

3. The method according to claim 1, wherein the one or more cosmetic color shades are selected from the group comprising: red, black, orange, white and brown.

4. The method according to claim 1, wherein at least one of the plurality of cosmetic color shades is one that is free of any color or one that contains frost pigments.

5. The method according to claim 1, wherein each of the plurality of blister wells has a predefined size for holding between 0.1 grams and 10.0 grams of the respective cosmetic color shades.

6. The method according to claim 1, wherein the one or more cosmetic color shades are formulated from compounds selected from the group comprising: cosmetic base, mica, red iron oxide, brown iron oxide, black iron oxide, titanium dioxide, bismuth oxychloride, D&C Red No. 7 Ca Lake, D&C Red No. 33 Al Lake, FD&C Yellow No. 5 Al Lake, FD&C Yellow No. 6 Al Lake, FD&C Blue No. 1 Al Lake and Manganese Violet.

7. The method of claim 1, wherein the predetermined formula is a ratio of whole blister wells from the plurality of blister wells.

8. The method of claim 1, wherein the predetermined formula is a ratio of whole and half blister wells from the plurality of blister wells.

9. The method of claim 1, further comprising providing an area of the shade chart that enables a consumer to enter a custom formula for reproducing a custom cosmetic color shade.

10. The method of claim 1, wherein the custom formula is a ratio of whole blister wells from the plurality of blister wells.

11. The method of claim 1, wherein the custom formula is a ratio of whole and half blister wells from the plurality of blister wells.

12. A method for mixing a plurality of cosmetic color shades at ambient temperature and without the use of a medium to melt the cosmetic color shades to form a single uniformly mixed cosmetic color shade also at ambient temperature comprising:

(a) utilizing a plurality of plastic or foil laminate tube or sachet packaging as a means for measurement;

(b) utilizing a plurality of cosmetic color shades specially formulated for pouring into one of the plurality of plastic or foil laminate tube or sachet packaging when heated or at ambient temperature, solidifying in the respective tube or sachet, and, after solidifying at ambient temperature, mixing with another one or more of the plurality of cosmetic color shades also at ambient temperature;

(c) utilizing a plurality of cosmetic color shades enclosed respectively in the plurality of plastic or foil laminate tube or sachet packaging, the plurality of cosmetic color shades comprising one or more color shades;

(d) utilizing at least one plastic spatula and one plastic board for mixing the selected plurality of the plurality of cosmetic color shades at ambient temperature to form a single uniformly mixed cosmetic color shade also at ambient temperature; and (e) utilizing a color shade chart, the color shade chart comprising instructions for reproducibly mixing a selection of the plurality of cosmetic color shades at ambient temperature to a desired single uniform cosmetic color shade at ambient temperature based on a predetermined formula, the predetermined formula based on combinations of the plurality of plastic or foil laminate tube or sachet packaging.

13. The method according to claim 12, wherein the plurality of cosmetic color shades are of one type selected from the group comprising: lipstick, lip gloss, foundation, cream blush and cream eyeshadow.

14. The method according to claim 13, wherein the one or more cosmetic color shades are selected from the group comprising: red, black, orange, white and brown.

15. The method according to claim 13, wherein at least one of the plurality of cosmetic color shades is one that is free of any color.

16. The method according to claim 13, wherein at least one of the plurality of cosmetic color shades contains frost pigments.

17. The method according to claim 13, wherein each of the plurality of plastic or foil laminate tube or sachet packaging has a predefined size for holding between 0.1 grams and 100.0 grams of the respective cosmetic color shades.

18. The method according to claim 13, wherein the one or more cosmetic color shades are formulated from compounds selected from the group comprising: cosmetic base, mica, red iron oxide, brown iron oxide, black iron oxide, titanium dioxide, bismuth oxychloride, D&C Red No. 7 Ca Lake, D&C Red No. 33 Al Lake, FD&C Yellow No. 5 Al Lake, FD&C Yellow No. 6 Al Lake, FD&C Blue No. 1 Al Lake and Manganese Violet.

19. The method of claim 13, wherein the predetermined formula is a ratio of whole plastic or foil laminate tube or sachet packaging from the plurality of plastic or foil laminate tube or sachet packaging.

* * * * *